United States Patent [19]

Winterling

[11] Patent Number: 4,688,716

[45] Date of Patent: Aug. 25, 1987

[54] PACKAGE BOX

[76] Inventor: Stig Winterling, Yrsnögränd 4, S-126 57 Hägersten, Sweden

[21] Appl. No.: 852,170

[22] Filed: Apr. 15, 1986

[30] Foreign Application Priority Data

Apr. 24, 1985 [SE] Sweden ..... 8501992

[51] Int. Cl.[4] ..... B65D 5/02

[52] U.S. Cl. ..... 229/137; 206/628; 206/815; 229/132; 229/905

[58] Field of Search ..... 229/132, 133, 137, 52 B, 229/905, 43, 134, 135, 136; 206/815, 628, 630

[56] References Cited

U.S. PATENT DOCUMENTS

| | | | |
|---|---|---|---|
| 1,921,150 | 8/1933 | Bomberger | 229/132 |
| 2,187,304 | 1/1940 | Farmer | 229/132 |
| 2,523,488 | 9/1950 | Williamson | 229/133 |
| 3,092,298 | 6/1963 | Scholle | 206/815 |
| 3,094,265 | 6/1963 | Houland | 229/133 |
| 3,126,143 | 3/1964 | Hagan | 229/132 |
| 3,187,976 | 6/1965 | Struble | 206/815 |
| 3,750,931 | 8/1973 | Dick | 229/132 |

FOREIGN PATENT DOCUMENTS

| | | | |
|---|---|---|---|
| 107343 | 5/1967 | Denmark | 229/132 |
| 480988 | 12/1969 | Switzerland | 229/132 |

*Primary Examiner*—Stephen Marcus
*Assistant Examiner*—Gary E. Elkins
*Attorney, Agent, or Firm*—Witherspoon & Hargest

[57] ABSTRACT

The present invention briefly relates to a package box (11) for the liquid tight sealing of the contents, preferably a liquid, which box (11) is folded from a cardboard blank, the side of which facing inwardly in the package box (11) is coated with a thin layer of plastic. The closing flaps (**12*a*, 13, 14, 15) extend each from its corresponding wall of the box (11) and are delimited from respective wall by a folding line (17). The longitudinal corner (19) of the box (11) between box bottom and lid is defined by two parallel folding lines (24, 25) and the recesses separating the flaps (12*a*, 13, 14, 15) terminate at a distance from the folding lines (17) of the flaps (12*a*, 13, 14, 15). The recesses preferably terminate in a section, the flange (23) of which is parallel to the folding lines (17) of the flaps (12*a*, 13, 14, 15) the length of such flange portion corresponding essentially to the distance between two parallel corner lines (24, 25**).

5 Claims, 6 Drawing Figures

PACKAGE BOX

Figure 2:
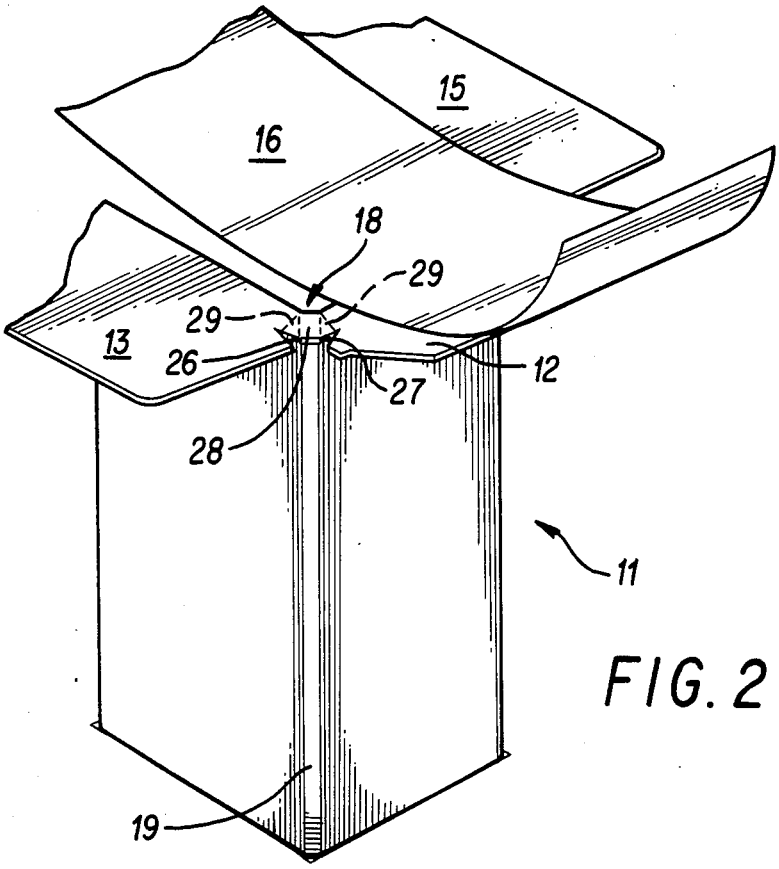

The present invention relates to package boxes, and in particular to a package box permitting liquid tight sealing of the contents.

The package box according to the invention is especially manufactured for freeze packaging of drinks, such as juices, juice-drinks and their concentrates, and similar. However, a person skilled in the packaging field realizes that the package box according to this invention is appropriate to be used in many packaging areas, where a simple, inexpensive and above all liquid tight package is required.

It is of great importance that packages, which are to contain such products as liquids, for instance juices, concentrates thereof and other drinks, are tight enough so that the product would not leak out. If, in addition, this type of package will be used for freeze packaging of its contents, the freezing will cause some mechanical stress on the package. If a package with its contents then will be sold at retail, it might on several occasions undergo rough handling during transportation, storage and retail selling. The package box has to be able to with stand such strain without breaking or even starting to leak.

A commonly used freeze package for juice and other drinks is comprised of a paper cylinder with a lid and a bottom of tin, the lid having a special tear-open strip made as a separate portion attached to the lid. Such a package has one advantage in being durable as far as handling is concerned, but besides that it has many drawbacks. The manufacturing thereof gets expensive due to its combination of four different parts; paper cylinder, lid, bottom and tear-open flap. In addition, there is the relatively expensive and complicated assembly of these parts.

From a transportation and storage view point this package will occupy an unnecessarily large space, since round packages do not fit either against each other or against plane walls, but will together with this type of round packages also transport and store large amounts of air. For the consumer this round package is cumbersome to empty, in that the tear-open flap may be difficult to grasp and that a ring of the lid is left around the edge of the paper cylinder after opening, and this ring prevents the frozen contents from coming out before it has thawed to a considerable extent. It is therefore not uncommon that the consumer opens the bottom with the help of a can opener and then presses the contents out.

One goal is to produce a rugged package in the form of a parallelepiped, which package could be used for freeze packaging of juice and other drinks, the package at the same time being inexpensive, simple and liquid tight. Such a simple and inexpensive package is disclosed by the Swedish patent specification No. 186.301, but this package has been designed for the packaging of dry products, preferably powders, and it does not have the kind of liquid proofness or assurance against leakage that is required for a freeze package of liquid.

A "square" package box is simple and cheap to produce and is appropriate for easy handling, from the packaging stage to being emptied by the consumer. Compared to a cylindrical package, it therefore has a numerous advantages. Though, it does have one weakness, which has made the package essentially impossible to use for packaging liquids, in that they have not managed to solve the proofness problem at those corners, where the folding flaps of the lid extend from the actual box body, that is, at the end thereof, which is to be closed after the filling of the contents, and which then is easily to be opened for the emptying of the contents from the package.

The present invention is to eliminate the above problem. This objective is achieved by a package box indicated by the claims, wherein also that which is characteristic of the invention appears.

Figure 1:
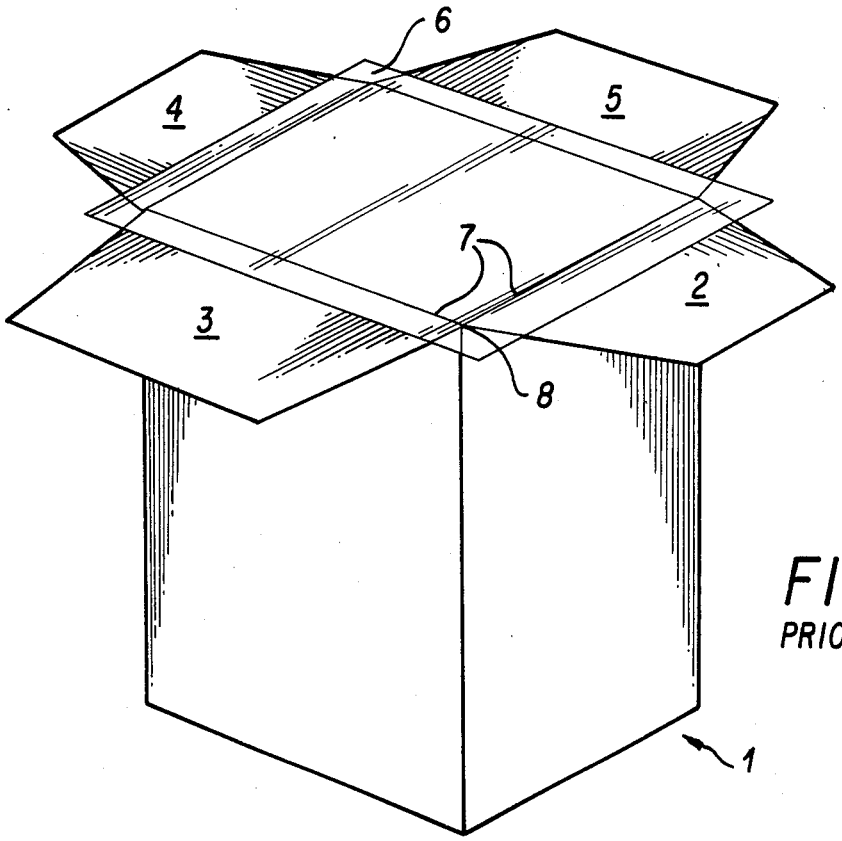
FIG. 1 PRIOR ART
Figure 3:
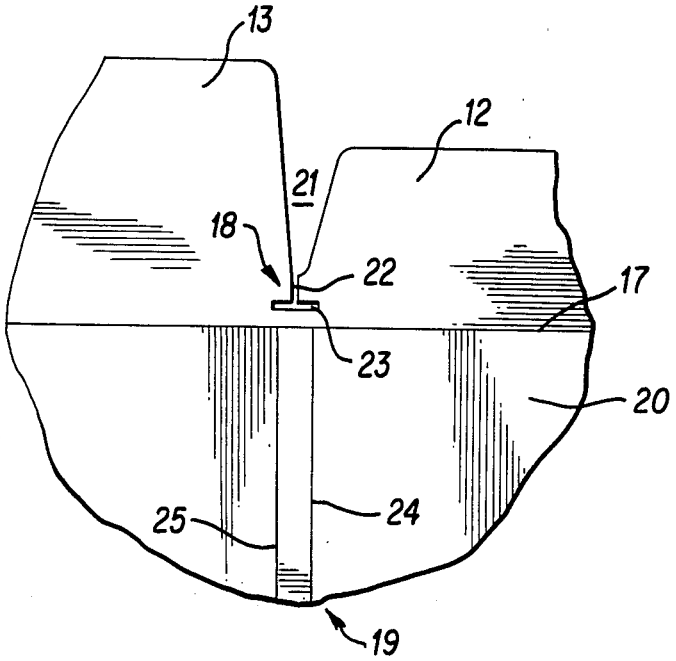
Figure 4:
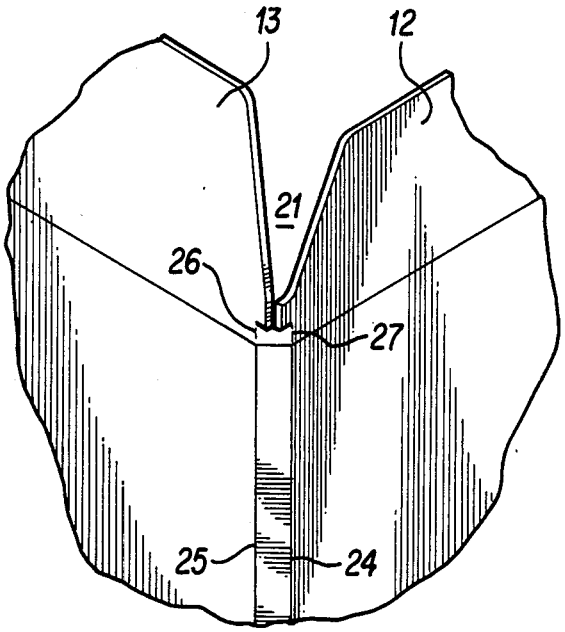
Figure 6:
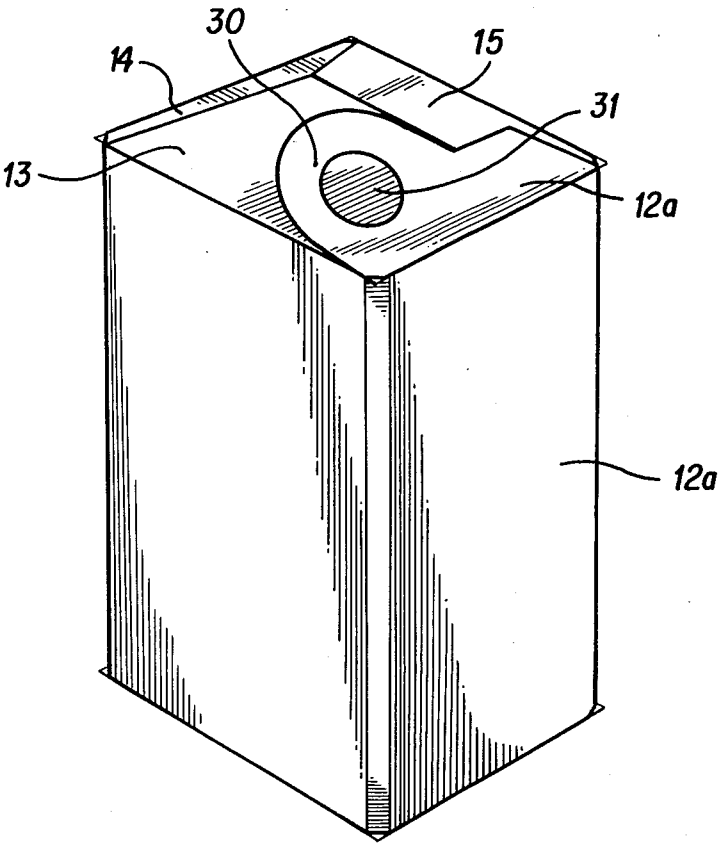
Figure 5:
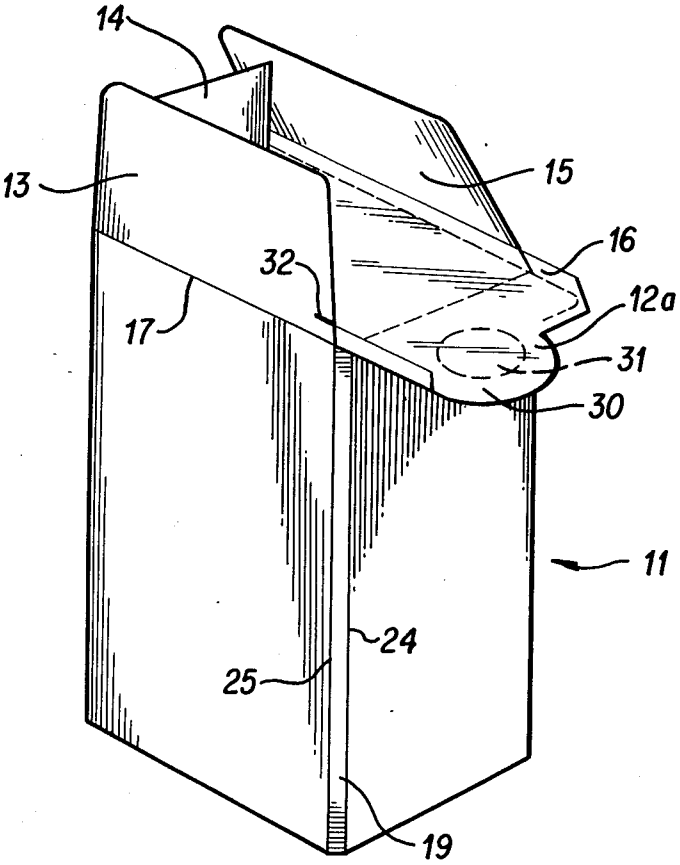

The invention will be described more in detail in the following with reference to the appended drawings, in which FIG. 1 is a schematic perspective view of a package box of the prior art, with unfolded closing flaps and the closing foil applied, FIG. 2 is a partially cut away perspective view showing a corner of a package box according to the invention, with the closing foil being applied, FIG. 3 is a cut away plane view of a package box cardboard blank showing a corner between a pair of closing flaps for a packagebox according to this invention, FIG. 4 is a perspective view showing the corner according to FIG. 3, the blank being in a folded state before the unfolding of the closing flaps, FIG. 5 is a perspective view of a package box according to the invention with applied closing foil and the folding of the closing flaps just started, and FIG. 6 shows a package box according to this invention in a completely closed state.

Package boxes of the kind being related to by this invention are manufactured by a laminated and/or impregnated paper material, the inwardly facing side of the package box being coated with a thin layer of plastic. Such a box is seen in FIG. 1. It is shown open having the closing flaps 2–5 unfolded essentially perpendicular to the box. A closing or plastic foil 6 is positioned over the opening and attached to the flaps 2–5 by heat sealing. When folding the box from a plane cardboard blank and then unfolding the flaps 2–5 thereof to the shown position along the folding lines 7, there is formed a little piece of material fluff in the corners 8 consisting of a torn-apart paper material. During heat sealing the plastic foil 6 is intended to adhere to this material fluff. This seal however turns out to be unreliable even if the piece of fluff should include a part of said thin layer of plastic, and when folding the closing flaps back to the closed position, a bending occurs right in these corners and there is a risk of the plastic foil 6 coming loose from the piece of fluff, to which the plastic foil 6 is intended to adhere. Even if the layer of plastic could be stretched out a little in the corners 8, thus forming a little bridge, this would not be sufficient to create a reliable and liquid tight fastening of the plastic foil 6. Thus, this known package box cannot be regarded as suitable for packaging liquid contents, and so much the less for the freeze packaging thereof, since freezing and thawing call for high demands on the mechanical durability of the package box.

Referring now to FIG. 2 there is shown, partially cut away, a corner 18 of a package box 11 according to this invention. A plastic foil 16 is in the process of being applied over the opening against all flaps 12–15, everything essentially in accordance with FIG. 1. The corner 18 as well as the upstanding corner 19 of shown package box 11 have been given a special design, which becomes evident from FIGS. 3 and 4.

With reference to FIG. 3 there is shown how a cardboard blank 20 of a package box 11 is designed at the corners 18 and 19 before folding. A creased folding line 17 separates the flaps 12, 13 from those parts of the blank 20 that will form the walls of the box 11. The flaps 12, 13 are spaced apart by an essentially V-shaped recess 21, the design being the same at all four corners of the box 11. The end of the V-shaped recess 21 terminates in a T-shaped section 22, the flange portion 23 of which is parallel to the folding line 17 and spaced therefrom at a small, predetermined distance. Two parallel, creased folding lines 24, 25 separate two adjacent walls of the box 11. They are positioned right across from the corners 18, spaced from each other at a distance corresponding to the length of the flange portion 23. For the sake of clarity the distance between the creased folding lines 24, 25 is shown excessively in the drawings. Preferably, the distance between the folding lines 24, 25 and the distance between the folding line 17 and the flange portion 23 have the ratio 2:1.

In FIG. 4 there is shown the same cut away corner as in FIG. 3 but after the folding of the box 11 is being started. The box 11 has been folded along the folding lines 24, 25, which here are marked as extending to the folding line 17. However, they could be extended all the way to the flange portion 23, which is marked at 26 and 27. When unfolding the closing flaps 12, 13 to the position shown in FIG. 2, the material of the package box is stretched out along the lines 26, 27, regardless of these lines being an extension of the creased folding lines 24, 25 or not. This unfolding of the closing flaps 12–15 takes place in conjunction with the plastic foil 16 being applied and sealed, whereby the heat from the heating process contributes to making the material of the package box, and in particular the inside of the plastic layer, soft, thus permitting a better dilatation. At the same time, there is formed a projecting tongue 28 between the bursting portions, which occur along the lines 26 and 27 in the actual box material, which bursting portions to a certain extent overlap the extended plastic film. Through the combined dilatation and up-breaking thus occurring, there would not be a tremendous stress on in particular the plastic layer, but there will be formed a bride 29 at each corner 18, against which the sealing plastic foil 16 can be fastened reliably and under liquid proofness.

When creasing the folding lines 24, 25 there is a contraction of the blank 20 material right in the corner portions 18, 19, and this material excess causes, when the closing flaps 12–15 are being unfolded, a stretching of this material excess to take place at each side of the tongue 28. The angle caused by the burstings may at the most amount to 45°, but due to the creasing they become in essence smaller. An angle of 45° is however not greater than that it can be overlapped by the plastic layer on the inside of the box.

In FIG. 5 there is shown a package box 11 according to the invention with the sealing plastic foil 16 in position and with the folding-up of the closing flaps 12–15 started. In order for the package box 11 to be easy to open, one of the flaps **12*a* at the narrower side of the box 11 is designed with a form rendering a good grip of the flap for the opening of the box. It order to facilitate the tearing-open procedure there is a slot 32 cut in the flap 13 parallel to the folding line 17 and from its edge adjacent to flap 12*a***.

The ready-to-go, folded-up package 11 is represented in FIG. 6. The closing flaps **12*a*, 13, 14, 15 are then folded so that the flap 13 with the slot 32, in order to facilitate the tearing-open procedure, is positioned right under the outermost flap 12*a*, which has a special shape for facilitating the tearing-open procedure. The flap 12*a* thus has a round hole 31, around which the flap 12*a* has a portion in the form of an arcute 30. The flaps at both ends of the box are glued so that they from a flat end, such flat ends giving stability to the lying packages, whereby the boxes having the fold design as described are positioned preferably lying on their sides, so that the compressive force from superincumbent boxes for the most part is carried by the flaps 13 and 15**.

As is obvious from FIG. 5 the plastic foil 16 extends over the entire inside of the flap **12*a*, and thus also over the hole 31. At the glueing of flaps 12*a*, 13, 14, 15, the flap 12*a* is adhered lighter to the other flaps than these are adhered to each other. This makes it easier for a person who opens the package box 11 to poke the flap 12*a* open, for example by inserting a finger nail under the arcute portion 30** and pull it up.

In order for the tearing-open procedure to be carried out correctly, so that it really comes about easily, the arcute portion 30 is displaced toward one side of the flap **12*a*, whereby the tearing automatically starts with the adjacent corner 18 and from where the subjacent flap 13 has its slot 28**, which is intended to facilitate the tearing-open.

During the tearing-open procedure the flap **12*a* comes loose along its folding line 17 against the actual box body, and the adjacent flap 13 comes loose along its corresponding folding line 17. Thereupon, the whole bed comprising the closing flaps 13–15 and the covering plastic foil 16, comes loose and the contents in the box 11 becomes available. The whole end of the box 11** is thereby removed and no parts prevent the box from being emptied of its contents.

During freezing and preferably also during transportation and storage the package box is preferably positioned lying on its end. In this position, as is mentioned above, the flaps 12–15 constitute a reinforcement of the box proper 11, at the same time as the effect is achieved that the contents do not fill up the box, but that the whole time there is an air gap between the contents and the superincumbent wall. The heat the contents are exposed to during opening of the box from the gripping thereof is sufficient to cause a tiny melting of the contents adjacent to the walls, and after opening, the box 11 is turned with its opening down, and the contents will come out. The air excess that occurs through said air gap into the area of the box bottom prevents the contents from not coming out due to vacuum therein. It is exactly this problem, that the contents so to say are retained by suction in the package, that is so troublesome with boxes and other packages, where the contents are frozen or coagulated in an upstanding package. In such cases, in order to get the contents out, the contents must have thawed or been dissolved to such an extent that they run easily in order for air to pass by and reach the package bottom under the contents. In the round packages of the above mentioned kind it is not uncommon that both ends of the package would have to be opened in order to get the frozen contents out.

As is evident from the above, there is provided by the present invention a package, which achieves the initially set objectives. However, for a person skilled in the actual art, many variations of the basic construction according to the invention are possible, but those variations are intended to stay within the frame of the appended patent claims.

I claim:

1. A tightly sealable package box having walls which meet at corners to form said box in a parallelepipedconfiguration, said box being folded from a cardboard blank of paper material, said blank of paper material having a side facing inwardly of the package box, said side being coated with a thin layer of plastic, the box including closing flaps defining a bottom and lid respectively, each flap extending from a respective wall of the box and being delimited from said respective wall by a folding line, each corner of the box extending between box bottom and lid and being defined by two parallel, creased lines, said paper material and plastic coating comprising slits which separate the flaps forming the lid and terminate at a distance from said folding line, each of said slits terminating in a cut through the paper material and plastic coating, each respective cut being parallel to the folding line of the flaps and of a length corresponding substantially to the distance between the two parallel, creased lines of each corner, said box including a ruptured area along said parallel, creased lines between said cut and said folding line to form a projecting tongue, and a portion of said plastic coating bridging said ruptured area.

2. Package box according to claim 1 wherein one of said closing flaps is provided with a gripping means which is asymmetrically positioned on the flap.

3. Package box according to claim 2 wherein one of said flaps is positioned directly under said one of said closing flaps and includes a slot parallel to the folding line of the flap.

4. Package box according to claim 2 wherein said gripping means is so located that when pulling the flap by said gripping means, the pulling force is concentrated to the corner of the box closest to said gripping means.

5. A tightly sealable package box having walls which meet at corners to form said box in a parallelepiped configuration, said box being folded from a cardboard blank of paper material, said blank of paper material having a side facing inwardly of the package box, said side being coated with a thin layer of plastic, the box including closing flaps defining a bottom and lid respectively, each flap extending from a respective wall of the box and being delimited from said respective wall by a folding line, each corner of the box extending between box bottom and lid and being defined by two parallel, creased lines, characterized by the fact that slits extend through the paper material and plastic layer, said slits separating the flaps forming the lid and terminating at a distance from said folding lines, each of said slits terminating in a cut through the paper material and plastic layer, each respective cut being parallel to the folding lines of the flaps and of a length corresponding substantially to the distance between the two parallel, creased lines of each corner.

* * * * *